United States Patent [19]

Nuzzo

[11] Patent Number: 4,807,947

[45] Date of Patent: Feb. 28, 1989

[54] DISPLAY CASE MOUNTING SYSTEM FOR SHELVING

[75] Inventor: Robert A. Nuzzo, Inverness, Ill.

[73] Assignee: Morgan Container Corp., Chicago, Ill.

[21] Appl. No.: 146,254

[22] Filed: Jan. 20, 1988

[51] Int. Cl.[4] ..... A47F 5/12

[52] U.S. Cl. ..... 312/140.4; 312/245; 248/295.1; 248/222.3; 248/223.2

[58] Field of Search ..... 108/65, 90, 97, 98; 312/140.4, 245; 248/295.1, 296, 222.4, 222.3, 223.2

[56] References Cited

U.S. PATENT DOCUMENTS

| | | | |
|---|---|---|---|
| 297,786 | 4/1884 | Goodman et al. | 248/296 |
| 1,801,637 | 4/1931 | Nichols . | |
| 2,628,051 | 2/1953 | Anderson . | |
| 2,787,433 | 4/1957 | Slavsky et al. . | |
| 2,898,069 | 8/1959 | Kramer . | |
| 2,935,209 | 5/1960 | Fritz | 108/97 X |
| 3,144,945 | 8/1964 | Seiz . | |
| 3,262,666 | 7/1966 | Solum . | |
| 3,346,126 | 10/1969 | Bloom et al. . | |
| 3,554,140 | 1/1971 | Homeberger | 108/90 |
| 3,664,626 | 5/1972 | Sneller . | |
| 3,710,096 | 1/1973 | McFarlin . | |
| 3,744,645 | 7/1973 | Hochman . | |
| 3,949,880 | 4/1976 | Fortunato . | |
| 3,986,318 | 10/1976 | McConnell . | |
| 3,986,649 | 10/1976 | Heimstra | 312/245 X |
| 4,138,019 | 2/1979 | Smith . | |
| 4,301,767 | 11/1981 | Willinger et al. . | |
| 4,709,891 | 12/1987 | Barnett . | |

*Primary Examiner*—Joseph Falk
*Attorney, Agent, or Firm*—Irwin C. Alter

[57] ABSTRACT

An adjustable, multi-element system for the mounting of display cases or containers on shelving. The system has two parts: a bracket assembly and a display case back wall to be used in conjunction therewith. The bracket assembly is comprised of a bracket arm, a retainer plate, and a mounting plate, onto which the display case or container locks. The retainer plate is adjustable relative to the bracket arm, whereby shelves of varying dimensions may utilize this system. These three elements are removably joined together by a wing nut and a bolt. The remaining element of this system is a sheet of material, which can be sized to serve as the back wall of display containers of various kinds, and which has an opening in it shaped complementarily to a projection from the mounting plate, whereby display cases utilizing this design may be locked onto the mounting plate. This locking function is accomplished by a vertical notch cut into the display case back wall component, which, in conjunction with the other shape features of the opening in this component, serves to stabilize the display case and lock it into a mounting position where it is properly aligned relative to the shelf surface.

20 Claims, 2 Drawing Sheets

DISPLAY CASE MOUNTING SYSTEM FOR SHELVING

BACKGROUND OF THE INVENTION

A retailer, who wants to remain competitive, must carry and display as many items per unit of floor area as he can reasonably and attractively fit. He does not want his customers to go down the street, where a competitor, with no larger display area than he has, is able to show a greater variety of items or more items of a given variety. The way to best utilize the floor area taken up by standard shelving units, or gondolas, is not only to stack items on top of each shelf surface, but to display them vertically, extending along and across the outside edges of the shelving units.

This invention is such a system for mounting and display in a consumer setting, which utilizes the vertical area between the shelves of a standard gondola and allows a merchandiser to best utilize his display area through the use of a bracket assembly and a specially designed container back wall, which can be fashioned for a variety of display containers. This system can conveniently increase, manyfold, the number of items he can show. While the idea of a vertical display system is not novel, this invention, and the particular elements which comprise the system, are an improvement over the prior art in several respects. The use of a bracket assembly mounted over the edge of a shelf is known in the art of merchandising display, but the best system prior to the present invention suffers from shortcomings and inconveniences which have been eliminated by the present invention.

Perhaps the most annoying aspect of the prior art device is the sheer number of parts required to set up the system and the correlative labor required for installation. Just to properly attach the bracket assembly to the shelf edge and prepare it for receiving the display container requires the tightening and securing of two hex nuts and bolts and one thumbscrew. Then the display container has to be prepared by placing a wire hook assembly into holes in its back wall. Finally, before the display container may be mounted onto the bracket assembly, a crossbar, used as a mounting support for the display container, must be levelled and securely tightened into the other components of the bracket assembly.

By contrast, the only external fastening device in the present invention is the wing nut and bolt union. Since the component parts of the present system are all designed to be integrated with each other, by means of projections from—and complementary openings in—the various elements, whereby they slide neatly into each to interlock, there is no need for anything but the simple bolt and wing nut to fasten them all securely.

Even more innovative, perhaps, is the improvement made in the design of the display container back wall itself. No time or effort need be taken to prepare the display container for mounting, either in terms of fussing with the crossbar or prior installation of the wire hook assembly into the container back. By virtue of a specially designed opening in the back wall, which is an element of the complete system in the present invention, the container is simply placed in the appropriate position over the complementary projection from the mounting plate, pulled down vertically into the slots behind this projection, and "mated" with the bracket assembly.

Thus, it is an object of the present invention to provide a display system with fewer component elements than has previously been possible, and one, therefore, which is easier to assemble.

It is another object of this invention to have the various elements of a display system be fashioned in a design whereby they may all be fitted together without the need for numerous external fastening devices.

It is yet another object of this invention to provide a bracket assembly in which the component parts are removably joined together in a manner which allows for the use of this invention with shelves of different dimensions.

It is further an object of this invention to provide, as an element of the display system, a display case back wall design, usable with display cases of various dimensions, which, by virtue of its inherent shape, can mate securely with the other elements of the system, without the need for the installation of external hooks or level crossbars.

It is still further an object of this invention to provide a display system whereby the simple, proper placement of the display container into the slots provided for it in the mounting plate of the bracket assembly ensures that the container will be locked in the proper horizontal and vertical alignment for display, relative to the shelf surface.

Other and further objects, advantages and features of my invention will become more readily apparent from the following description, especially when taken in conjunction with the various drawings, in which:

DETAILED DESCRIPTION OF THE INVENTION

Figure 1:
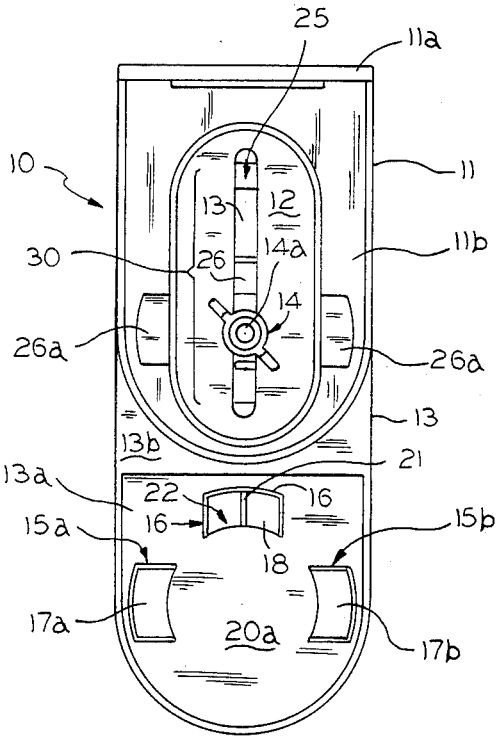
FIG. 1 is a rear elevational view of that portion of the mounting system of the present invention comprising the bracket arm, the retainer plate, and the mounting plate, joined together by a wing nut and bolt.

Referring generally to the figures in the drawings, wherein like parts are indicated by corresponding numerals throughout the several views, FIG. 1 consists of the rear view of a tripartite bracket assembly, including the means for associating said bracket assembly with a shelf, and denoted generally by reference character 10, the elements of which bracket assembly are an "L"-shaped bracket arm 11, which has a horizontal component 11*a* (shown foreshortened in FIG. 1 and seen clearly in FIG. 3) and a vertical component 11*b*, a retainer plate 12, and means for mounting a display container onto said bracket assembly, namely, a mounting plate 13, whose upper portion is denoted by 13*b* and whose lower portion is denoted by 13*a* in this rear view.

Figure 2:
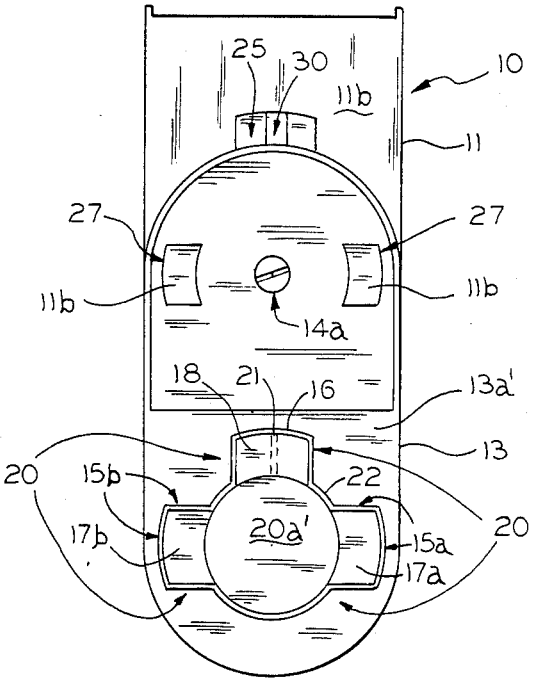
FIG. 2 is a front elevational view of the three elements of FIG. 1.

The vertical component 11*b* of the bracket arm 11 has an opening 25 therein shaped like a keyhole (a little more of which is visible in FIG. 2), mostly hidden in the drawings by the retainer plate 12 in FIG. 1 and the mounting plate 13 in FIG. 2, through which a winged projection 26 protruding from the rear surface 13*b* of the upper portion of the mounting plate may be inserted. The wings extending laterally from said projection 26 are denoted by 26*a*.

The retainer plate 12 has a slot 30 running longitudinally down its center through which said retainer plate is connected to the rest of the bracket assembly 10 by fastening means which are a wing nut 14 and a bolt 14*a*. Said slot 30 is also the means whereby the retainer plate 12 is mobile relative to the bracket arm 11 and through which the bracket arm is securely mounted to a shelf 40 (see FIG. 5) when the wing nut 14 and the bolt 14*a* hold the retainer plate to the shelf lip 40*a* and the latter is thereby held against the bracket arm 11 with maximum tightness.

Two slots or openings 15*a* and 15*b* are formed on either side of the lower portion 13*a* of the mounting plate 13 and another slot or opening 16 is formed in the middle of the lower portion of the mounting plate, but closer to the top portion than the two side slots. These three slots 15*a*, 15*b* and 16 are formed behind a projection 20 (see FIG. 2) with wing-like extensions 17*a*, 17*b* and 18, pointing outwardly from the sides and middle, respectively, of the circular central portion 20*a*′ (see FIG. 2) of the projection 20 protruding from the lower front portion 13*a*′ of the mounting plate 13.

Also visible in FIG. 1 is a finger-like extension of material 21 from the main body of the mounting plate 13 which extends outward from the perimeter 22 of the back surface 20*a* of the circular central portion of the projection along the vertical axis of the mounting plate.

FIG. 2 consists of the front view of the bracket assembly 10 wherein the projection 20, including the three wing-like extensions therefrom, 17*a*, 17*b* and 18, from the two sides and middle, respectively, from the front surface 13*a*′ of the lower portion of the mounting plate, is shown. As can be seen from FIG. 2, these extensions point outwardly from the perimeter 22 of the front surface 20*a*′ of the circular central portion of the projection 20. Also seen in FIG. 2 are the slots or openings 27 behind the wings 26*a* extending from the projection 26 from the rear surface 13*b* of the upper portion of the mounting plate 13 and into which the vertical component 11b of the bracket arm is fitted, and whereby the mounting plate 13 may be semi-securely interlocked with the bracket arm 11. Note that the mounting plate in FIGS. 1 and 2 has been rotated or vertically swivelled into alignment with the vertical component of the bracket arm 11b whereby the visual image created is that of one uniform article with parallel sides. This is the proper relative position for these two components when the display container is mounted on a horizontal shelf surface like those depicted in FIGS. 5 and 8. In this mode of operation and for this mounting position, the mounting plate 13 is pulled down (away from the horizontal component of the bracket arm 11*a*) into the opening 25 in the vertical component of the bracket arm 11*b* as far as it will go.

Figure 3:
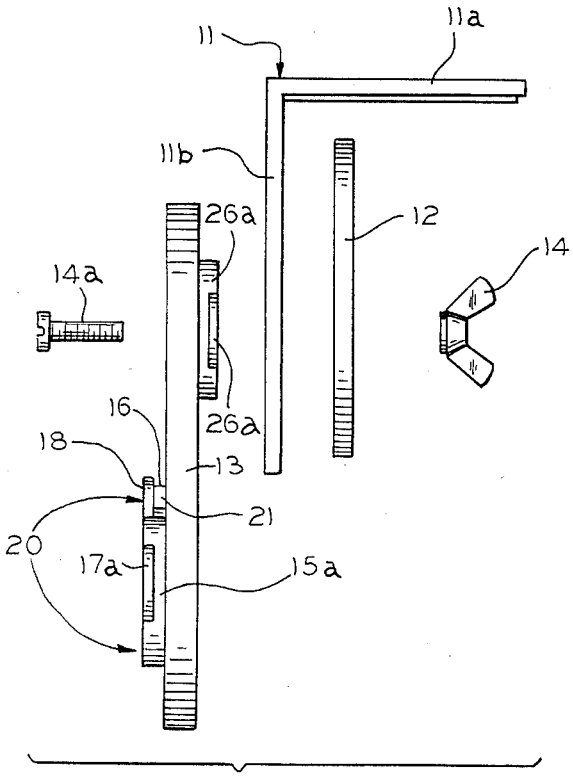
FIG. 3 is a side elevational view of the three elements of FIG. 1 and the wing nut and bolt in their dis-assembled state.
Figure 4:
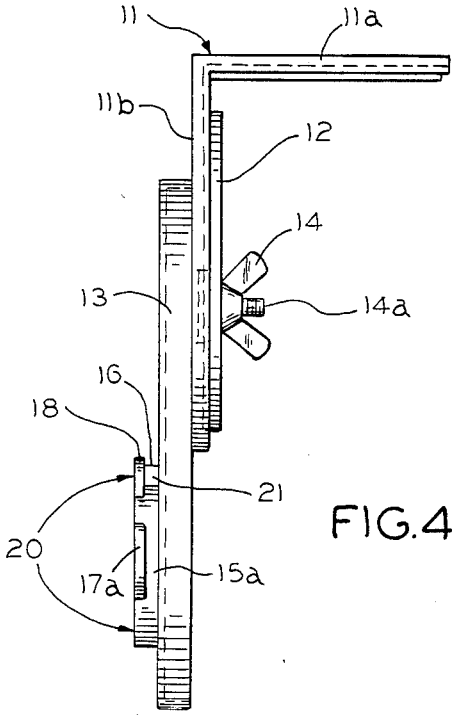
FIG. 4 is a side elevational view of the assembled elements of FIG. 1.
Figure 5:
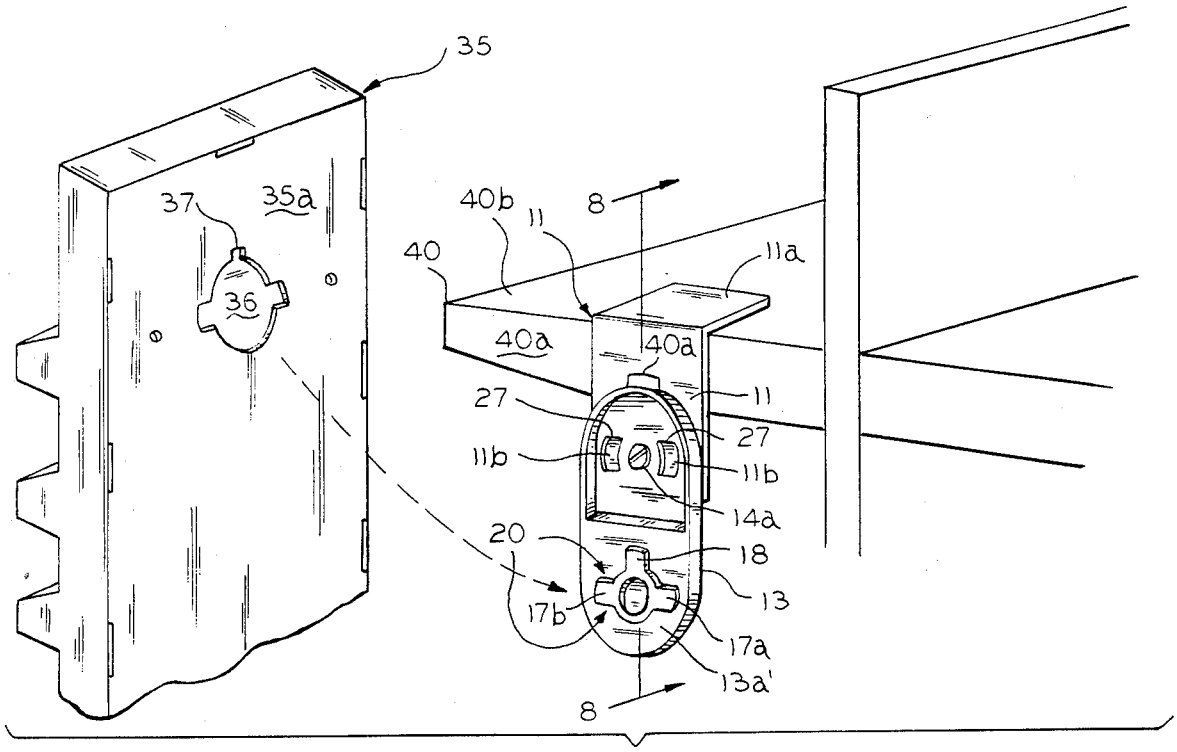
FIG. 5 includes all the elements of the present invention, presented in two views: a perspective front view of the bracket assembly secured onto the edge of horizontal a shelf, and also a perspective view, not to scale, of a display container whose back wall utilizes the design of the present invention.
Figure 8:
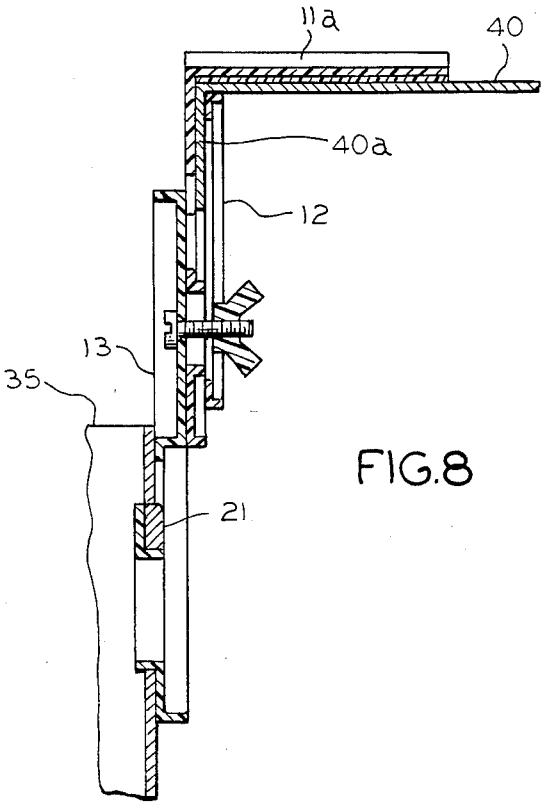
FIG. 8 is a cross-sectional view of the complete system of the present invention in one made of operation, which is, essentially, a view taken along 8—8 of FIG. 5, with the addition of part of a display container shown in mounted position.

The bracket assembly 10 elements are shown disassembled in FIG. 3 and tightly assembled in FIG. 4. This tight assembly is indicated by the fact that only the end distal from the head of the screw thread shaft of the bolt 14*a* is showing, and the retainer plate 12 is contiguous to the vertical component 11*b* of the bracket arm. Note that, unlike the depiction of the bracket assembly 10 shown cross-sectionally in FIG. 8, where a shelf lip 40*a* has been inserted between the bracket arm 11 and the retainer plate 12, the bracket assembly 10 in FIG. 4 is shown unmounted. The length of the bolt shaft 14*a*, then, allows the three elements 11, 12 and 13, of the bracket assembly 10 to be fastened tightly enough such that they will not come apart, but loosely enough to slide the bracket assembly 10 into a mounting position without the need to dis-assemble, completely, the bracket assembly. This same variability in tightening capacity among the components 11, 12 and 13 of the bracket assembly 10 and the bolt 14*a* and wing nut 14 is what enables the invention to be used with shelves having vertical lips of varying thicknesses. Because a loosely fastened retainer plate 12 is also enabled to move longitudinally relative to the vertical component 11*b* of the bracket arm 11, it can be appreciated that the invention may also be used with shelves which, themselves, vary in thickness. FIG. 5 and FIG. 8 show the bracket assembly 10 properly fastened to a horizontal shelf 40. The horizontal component 11*a* of the bracket arm is flush with the top surface of the shelf, and the vertical component of the bracket arm 11*b* is flush with the shelf lip 40*a*. Note that the bracket arm 11 and the mounting plate 13 are also properly positioned relative to each other for this mounting position, creating one uniform vertical section.

The relationship between the specialized back wall design 35*a* of a display container 35 and the bracket assembly 10 elements of this system is highlighted in FIG. 5 by an arrow drawn between the opening 36 in the sheet of material comprising the back wall 35*a* and the projection 20 from the lower front portion 13*a*′ of the mounting plate. This arrow indicates the intended integration of the two parts of the display system comprising this invention: when the display case 35 with the complementarily shaped opening 36 in its back wall 35*a* is mounted on the projection 20 in the mounting plate 13, the system is complete.

Figure 6:
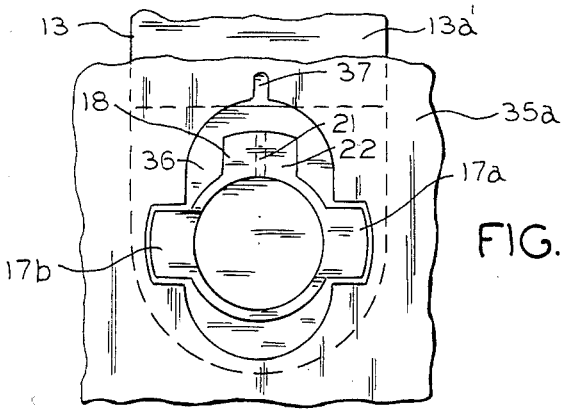
FIG. 6 shows a close-up of that portion of the mounting plate onto which the back wall of a display container, shown cut away, is fitted, before it is slid into locked position.

FIG. 6 shows, in cut-away fashion, the physical placement of the two elements 35*a* and 13, indicated by the arrow in FIG. 5. Note that the notch 37 portion of the opening 36 in the back wall 35*a* of the display container 35 is positioned directly above the middle wing-like extension 18 from the projection 20 on the mounting plate 13, so that when the container is pulled down, as shown by the arrow in FIG. 7, and its back wall 35*a* is slid into the slots 15*a*, 15*b* and 16 (see FIG. 2) behind the projection 20 in the mounting plate 13, said back wall fits snugly into said slots behind the projection, whereby, of course, so does the whole display container 35.

Figure 7:
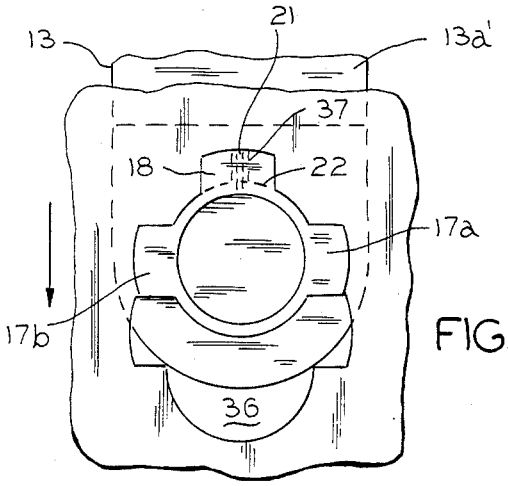
FIG. 7 shows the elements of FIG. 6 properly locked into position.

More particularly, as may be seen from FIG. 7, the notch 37 portion of the opening 36 in the back wall 35*a* of the display container, fits over the finger-like extension of mounting plate material 21 (shown in phantom in FIGS. 6 and 7), which is directly behind and attached to the middle wing-like extension 18 from the projection 20 in the mounting plate 13, thereby locking the display container 35 into position with both its horizontal and vertical axes properly aligned relative to the horizontal shelf surface.

FIG. 8 is a cross-sectional view of the mounted bracket assembly 10 shown in FIG. 5, with the addition of a cut-away portion of a display container 35, showing its back surface 35*a* fitted snugly into position, as described in reference to FIGS. 6 and 7.

From the preceding description it becomes apparent that an improved display case mounting system for shelving has been described, and the objects of the invention have been fulfilled. In particular, my invention utilizes a simplified bracket assembly system in which the elements fit together in such a way that the need for multiple external fastening devices is obviated. A further simplifying innovation is the use of a specially designed back wall element for display containers, which, when integrated with the other elements of the system, obviates the need for external mounting hooks and support bars, which, in the prior art device, must be separately installed and adjusted.

It is, of course, understood that the description herein is by way of illustration, rather than limitation. Changes, modifications and various applications of this invention may be made without departing from the spirit and scope of the invention, especially as defined by the scope of the claims appended hereto.

Having thus described my invention, what I claim and desire to secure by Letters Patent in the United States is:

1. A display case mounting system bracket assembly for shelving which comprises an angle bracket arm and a retainer plate; means for removably connecting said angle bracket arm and retainer plate in a manner to permit their rigid mounting on a shelf; a mounting plate removably carried on said angle bracket arm, said mounting plate defining projection means facing away from said arm, said projection means defining outwardly extending, wing-like extensions carried by the projection means in a manner spaced from the remainder of the mounting plate to define a slot therebetween, whereby a display container may be mounted on said mounting plate by inserting the projection means through an opening in the back wall of said display container and allowing said display container to laterally move slightly to cause a portion of said back wall to enter said slot; said mounting plate also carrying second projection means defining lateral extensions facing toward said arm and projecting through an aperture of said arm in interlocking relation therewith, said second projection means and aperture being respectively shaped to permit said second projection to enter the aperture in a first rotational position and to be locked together by moving to a second rotational position, whereby portions of said bracket arm occupy slots adjacent said lateral extensions to lock the mounting plate and bracket arm together.

2. A mounting system for shelving as set forth in claim 1 wherein the bracket arm is mounted on a shelf surface which has a lip extending perpendicularly therefrom and wherein the bracket arm may be secured to the shelf surface by the retainer plate in a manner whereby the bracket arm and mounting plate attached to it are properly positioned to receive the display container.

3. A mounting system for shelving as set forth in claim 2 wherein the bracket arm is a one-piece "L" shaped unit having a component and a vertical component.

4. A mounting system for shelving as set forth in claim 2 wherein the retainer plate is attached to the other components comprising the rest of the bracket assembly by fastening means and is formed for movement in various directions relative to other portions of said bracket assembly while said fastening means hold said retainer plate in association with said bracket assembly, including the mounting plate which is attached to the bracket arm portion of said bracket assembly.

5. A mounting system for shelving as set forth in claim 4 wherein the retainer plate has a slot running longitudinally down its center, the width of which slot is larger than the diameter of the fastening means by less than fifty percent of the length of the diameter of the fastening means, and through which slot the fastening means is inserted to connect said retainer plate to the bracket arm, said slot being also the means whereby said retainer plate is enabled to move relative to the other portions of said bracket assembly.

6. A mounting system for shelving as set forth in claim 4 wherein the means for attaching the retainer plate to the remainder of the bracket assembly includes a wing nut and bolt.

7. A mounting system for shelving as set forth in claim 6 wherein the bracket arm is connected to a shelf by having the wing nut and bolt fastened in a manner which permits maximum movement between the bracket arm and the retainer plate and wherein the horizontal component of the bracket arm is positioned on top of and flush with the top surface of the shelf, whereby the shelf lip is parallel to and flush with the back surface of the vertical component of said bracket arm, and whereby said shelf lip will thereby be positioned between the back surface of said vertical component and the retainer plate, and whereby the retainer plate will be permitted to slide up toward the underside of the shelf surface until the top of said retainer plate is touching said shelf, whereafter the wing nut and bolt may be tightened until the retainer plate is pressing securely against the shelf lip.

8. A mounting system for shelving as set forth in claim 6 wherein, when the bracket assembly is disassembled, a keyhole-shaped opening in the vertical component of bracket arm is revealed through which a projection from the rear surface of the mounting plate may be inserted, whereby the mounting plate may be semi-securely attached to and interlocked with said bracket arm, even in the absence of the wing nut and bolt.

9. A mounting system for shelving as set forth in claim 8 wherein the mounting plate is further secured to the bracket arm by tightening the same wing nut and bolt which fasten the shelf-associative portion of the bracket assembly to the shelf.

10. A mounting system for shelving as set forth in claim 8 wherein the projection protruding from the rear surface of the mounting plate has two wing-like lateral extensions therefrom, said wings extending outwardly from the left and right sides, respectively, of the projection.

11. A mounting system for shelving as set forth in claim 1 wherein the bracket arm has a portion which is mounted on a shelf surface and said mounting plate for mounting said display container onto the bracket assembly removably attaches to a portion of said bracket arm which is distal from the portion of said bracket arm mounted on the shelf surface.

12. A mounting system for shelving as set forth in claim 1 wherein the mounting plate has, protruding from its front surface, a projection means comprised of a circular central portion with three wing-like extensions pointing outwardly from the perimeter thereof.

13. A mounting system for shelving as set forth in claim 12 wherein two of three wing-like extensions extend laterally from the left and right sides, respectively, of said central portion, and the third wing-like extension is located above and equidistant from the two lateral wing-like extensions and points upward from the perimeter of said central portion along the verticl axis of said mounting plate.

14. A mounting system for shelving as set forth in claim 13 wherein the opening in the back wall of the display container is formed in a shape complementary to, in the manner of female to male, the projection protruding from the front surface of the mounting plate, whereby it may be fitted over said projection and slid securely down into the slots formed between said projection and the rest of the body of the mounting plate.

15. A mounting system for shelving as set forth in claim 13 wherein, because of the specific nature of the slot formed behind the middle, upwardly extending wing-like extension of the projection, the display container can be made to lock into display-ready position with both its vertical and horizontal axes properly aligned in relation to the shelf surface.

16. A mounting system for shelving as set forth in claim 15 wherein, even after it has been locked into display-ready position on the mounting plate, the display container may be easily unlocked from this position by lifting it upward.

17. A mounting system for shelving as set forth in claim 15 wherein the slot shape formed by the space between the middle wing-like extension of the projection and the rest of the body of the mounting plate is interrupted and partially filled in by a finger-like extension of material from the rest of the body, formed from part of the mounting plate which was left intact when the projection was stamped out, and which extends outward from the perimeter of the back surface of the circular central portion of the projection along the vertical axis of the mounting plate.

18. A mounting system for shelving as set forth in claim 17 wherein the portion of the opening in the back wall of the display container which is complementary to, and mates with, the middle wing-like extension of the projection protruding from the mounting plate, is formed in the manner of a notch, running along the vertical axis of said back wall.

19. A mounting system for shelving as set forth in claim 1 wherein said angle bracket arm has a horizontal component and a vertical component, and:

the retainer plate and the mounting plate are, in outline, both oblong-shaped, with arcuate short ends, and wherein the vertical component of the bracket arm is shaped similarly from its midline down to the end distal from the shelf surface, but the upper portion of said vertical component, which associates with the shelf, has a straight edge, and this edge is joined at a ninety (90) degree angle with the horizontal component of said bracket arm, which component is trapezoidal in shape.

20. A mounting system for shelving as set forth in claim 19 wherein the bracket arm, retainer plate, and mounting plate are made of a semi-rigid, non-breakable material like rubber, and the back wall element for the display container is made of cardboard.

* * * * *

UNITED STATES PATENT AND TRADEMARK OFFICE

CERTIFICATE OF CORRECTION

PATENT NO. : 4,807,947

DATED : February 28, 1989

INVENTOR(S) : Robert A. Nuzzo

It is certified that error appears in the above-identified patent and that said Letters Patent is hereby corrected as shown below:

| | |
|---|---|
| Col. 2, lines 49,50 | "horizontal a", should be --a horizontal--. |
| Col. 2, line 60 | "made", should be --mode--. |
| Col. 6, line 5 | After "having a", should be --horizontal--. |
| Col. 7, line 19 | "verticl", should be --vertical--. |

Signed and Sealed this

First Day of August, 1989

*Attest:*

*Attesting Officer*

DONALD J. QUIGG

*Commissioner of Patents and Trademarks*